US006199736B1

(12) United States Patent
Musarella et al.

(10) Patent No.: US 6,199,736 B1
(45) **Date of Patent: *Mar. 13, 2001**

(54) TOOL HOLDER

(75) Inventors: Michael Musarella, Staten Island, NY (US); Steve Hnatowicz, Brodheadsville, PA (US)

(73) Assignee: EZ Hook Inc., Brodheadsville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/385,612

(22) Filed: Aug. 30, 1999

Related U.S. Application Data

(62) Division of application No. 08/649,057, filed on May 16, 1996, now Pat. No. 5,944,242.

(51) Int. Cl.[7] ..... A45F 5/00
(52) U.S. Cl. ..... 224/667; 224/904
(58) Field of Search ..... 224/904, 269, 224/666, 667, 248, 270, 669, 678; D3/228, 215, 219

(56) References Cited

U.S. PATENT DOCUMENTS

| | | | |
|---|---|---|---|
| D. 240,370 | 7/1976 | Kuehl | D3/228 |
| D. 258,550 | 3/1981 | Strauss | D3/228 |
| D. 261,197 | 10/1981 | Rowswell | 224/904 |
| D. 273,821 | 5/1984 | Bianchi | D3/215 |
| D. 345,052 | 3/1994 | Stokke et al. | D3/228 |
| D. 374,604 | 10/1996 | Hnatowicz et al. | D3/228 X |
| 1,326,887 | 12/1919 | Wood | 224/904 |
| 3,200,536 | 8/1965 | Petitto, Sr. | 224/269 X |
| 3,777,953 | 12/1973 | Lewis | 224/666 X |
| 4,307,825 | 12/1981 | Pattermann | 224/904 |
| 4,358,036 | 11/1982 | Maltais | 224/667 |
| 4,372,468 | 2/1983 | Harvey | 224/904 |
| 4,457,462 | 7/1984 | Taormina | 224/269 |
| 4,523,702 | 6/1985 | Viio | 224/904 |
| 4,638,530 | 1/1987 | Perry | 224/904 |
| 4,645,104 | 2/1987 | Vokaty | 224/904 |
| 4,790,461 | 12/1988 | Stover | 224/904 |
| 4,827,614 | 5/1989 | Mitchell | 224/904 |
| 4,830,244 | 5/1989 | Brannon | 224/269 X |
| 4,919,317 | 4/1990 | Luedtke | 224/151 |
| 4,936,499 | 6/1990 | Gulley | 224/252 |
| 5,052,603 | 10/1991 | Spina | 224/904 |
| 5,176,302 | 1/1993 | Smith | 224/252 |
| 5,195,667 | 3/1993 | Gallant | 224/904 |
| 5,201,445 | 4/1993 | Axelman | 224/904 |
| 5,210,532 | 5/1993 | Knoedler et al. | 224/269 X |
| 5,499,429 | 3/1996 | Higginbotham | 24/3.11 |
| 5,511,705 | 4/1996 | Dreszer | 224/252 |

*Primary Examiner*—Renee Luebke
(74) *Attorney, Agent, or Firm*—Pennie & Edmonds LLP

(57) ABSTRACT

A tool holder for mounting on a user's belt. The tool holder includes a support member having two front supports and two rear supports. Each rear support has a rear top portion, a rear bottom portion, and a rear transition portion positioned therebetween. Each front support is spaced from and biased substantially parallel to the rear top portion and is nonparallel to the rear bottom portion. Each rear transition portion extends toward the front support to provide a narrow gap which is smaller than the spacing between the front support and rear top portion, and the rear supports are connected by a support cross member. A bracket member extends between and connects the front supports, and a tool holding portion is provided for holding a tool. When the tool holder is mounted on a user's belt, front supports and rear transition portions provide resistance to removal of the support member from the belt.

13 Claims, 12 Drawing Sheets

TOOL HOLDER

CROSS-REFERENCE TO RELATED APPLICATIONS

This application is a divisional of application Ser. No. 08/649,057 filed May 16, 1996, now U.S. Pat. No. 5,944, 242.

FIELD OF THE INVENTION

The invention relates to a tool holder for mounting on a user's belt. More particularly, the invention is related to a tool holder that is mountable on a user's belt and resists removal therefrom.

BACKGROUND OF THE INVENTION

Carpenters, electricians, and other workmen typically have a need for a device that allows a tool to be carried on their person in such a fashion that the tool is easily accessible yet secure. A tool holder can provide hands-free support of a tool such as a hammer, allowing a workman to complete various tasks for which the tool may be handy yet not necessary at all times. The tool holder additionally permits a tool to be transported as a workman moves from one task to the next.

It is desirable to have a tool holder that is easy to manufacture, and provides a workman with good value. Such a tool holder should be inexpensive and durable. The tool holder should be light and compact.

As typical tool holders must attach to a belt for convenient use by a workman, several solutions to this problem are known. For instance, a slotted support pad with a cradle-like collar, such as taught in U.S. Pat. No. 4,790,461, is known for holding a hammer. A waist belt fits through the slots, thereby securing the pad to the person wearing the belt. A slotted support pad with a rotatable holder is also known, as taught in U.S. Pat. No. 5,195,667, which secures the head of a hammer, and is also taught in U.S. Pat. No. 4,372,468 which additionally has spring-biased retention gates on the tool support.

U.S. Pat. No. 1,326,887 teaches a tool carrier which clips to EL user's belt. The carrier is formed from a single length of wire which is bent to form arms for supporting a hammer. The ends of the wire are also bent to provide spring clips which attach to the belt. The clips, however, have rounded terminals that extend behind the belt and create concentrated pressure points against the user.

U.S. Pat. No. 5,511,705 teaches a storage device for clipping onto a belt. Hooks formed from wire secure the storage device to a belt, however, the hooks do not resist removal of the tool holder from the belt. A tool carrier with clip members is similarly disclosed in U.S. Pat. No. 4,936, 499, having a tool insertion portion with side rail members connected by an arcuate end bar. The end bar lies in the same plane as the side rail members. The clip members are connected by a connecting bar, however, the clip members are nonparallel and so the connecting bar is shorter than the distance between the side rail members.

U.S. Pat. No. 4,457,462 teaches a tool holder formed from a single length of wire and having a circular portion for holding a tool. The ends of the wire are bent to form U-shaped portions which receive a belt. Once the tool holder is placed on a belt, however, the U-shaped portions may tilt with respect to the belt when, for example, a worker bends at his waist, thereby providing uneven support for the tool. To remove the holder from a belt, the belt must be unthreaded through the U-shaped portions.

U.S. Pat. No. 5,176,302 teaches a holder formed from a single length of wire for supporting the handle of a container. Similarly to the '462 patent, a user's belt must be unthreaded through loop portions which may also rest unevenly on the belt if the worker bends.

U.S. Pat. No. D-374,604 discloses a design for a tool holder which is made of a bent wire. While this design is useful, it is relatively rigid and cannot rotate or otherwise adjust to the position of the user.

Accordingly, it is desirable to have a tool holder that is mounted on a user's belt and resists removal therefrom while also providing additional advantages over known designs.

SUMMARY OF THE INVENTION

The invention relates to an improved tool holder for mounting on a user's belt. This invention also resists removal from a belt while accommodating movement or changes of position of the user. Alternatively, some of these improved designs provide ease of insertion of the tool into the tool holder.

The tool holder of the invention generally includes a support member having two front supports and two rear supports. Each rear support has a rear top portion, a rear bottom portion, and a rear transition portion positioned therebetween. Each front support is spaced from and biased substantially parallel to the rear top portion and is nonparallel to the rear bottom portion. Each rear transition portion extends toward the front support to provide a narrow gap which is smaller than the spacing between the front support and rear top portion, and the rear supports are connected by a support cross member. A bracket member extends between and connects the front supports, and a tool holding portion is provided to for holding a tool. When the tool holder is mounted on a user's belt, front supports and rear transition portions provide resistance to removal of the support member from the belt. Preferably, the rear bottom portions of the support member extend away from the front supports, and the rear bottom portions of the support member are of substantially the same length as the rear top portions.

In one embodiment, the tool holding portion comprises a plurality of opposing gate members operatively associated with the support member. Each gate member is preferably mounted substantially perpendicularly to the rear supports of the support member, and is pivotably mounted about a pivot pin and biased in opposing position by a spring. Each gate member may be mounted on a side member which forms a lower end of a front support, or each side member can be joined to form a U-shaped portion that is pivotably connected to the bracket cross member.

In another embodiment, the tool holding portion comprises a wire bent to form a substantially rectangular shape. The bent wire may be mounted substantially perpendicularly to the rear supports of the support member. If desired, one end of the wire can be pivotably connected to the bracket cross member.

For either embodiment, the pivotable connection may be a cover plate connected to the bracket cross member by a pivot pin.

DETAILED DESCRIPTION OF THE PREFERRED EMBODIMENT

Figure 1A:
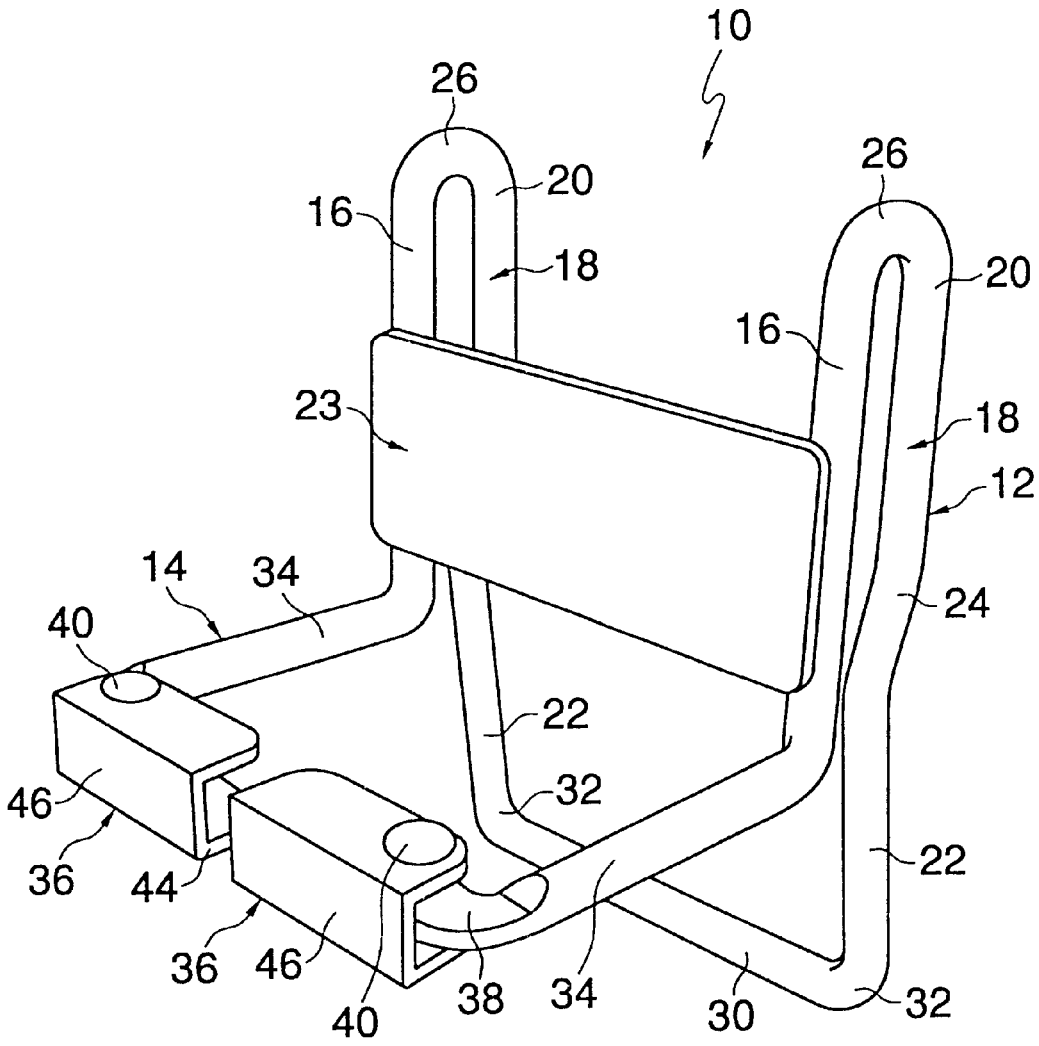
FIG. 1A is a perspective view of a first embodiment of a tool holder according to the present invention.
Figure 1B:
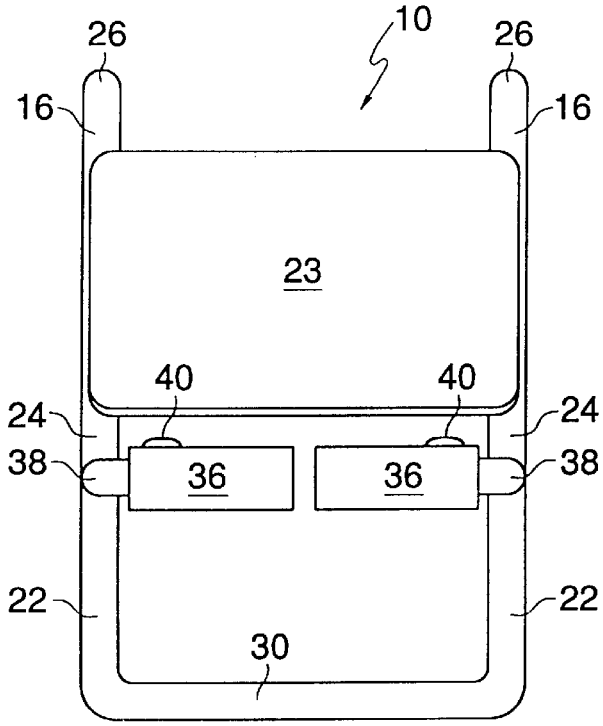
FIG. 1B is a front view of the tool holder of FIG. 1A.
Figure 1C:
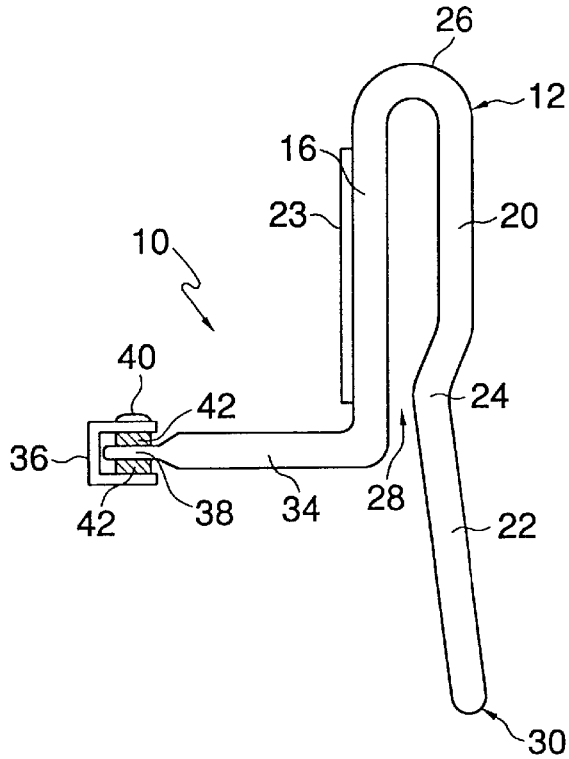
FIG. 1C is a side view of the tool holder of FIG. 1A.
Figure 1D:
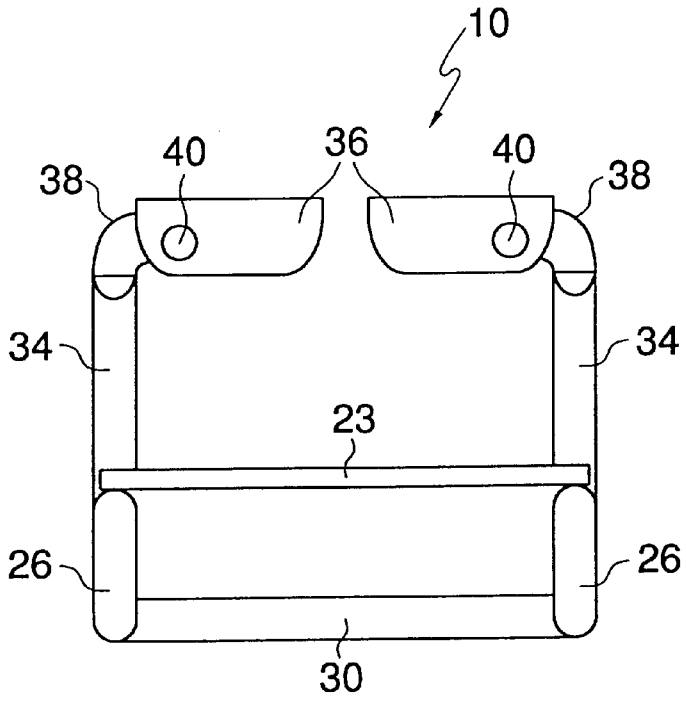
FIG. 1D is a top view of the tool holder of FIG. 1A.
Figure 1E:
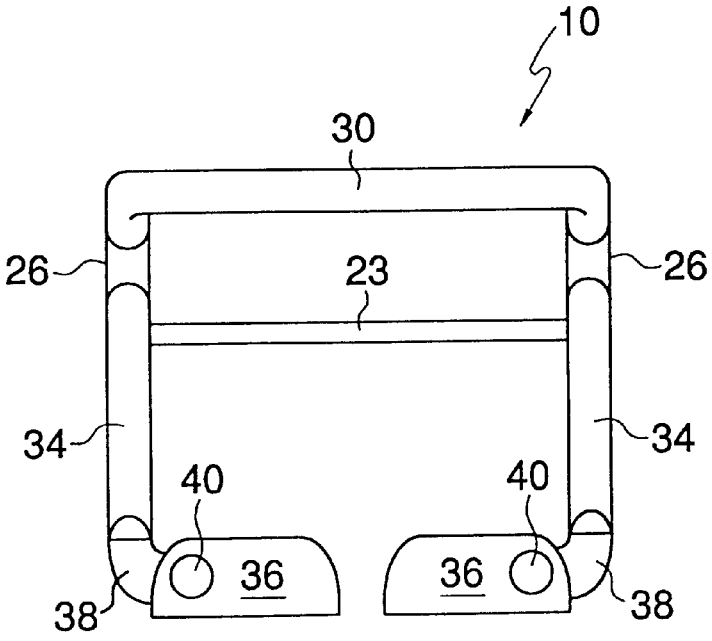
FIG. 1E is a bottom view of the tool holder of FIG. 1A.
Figure 1F:
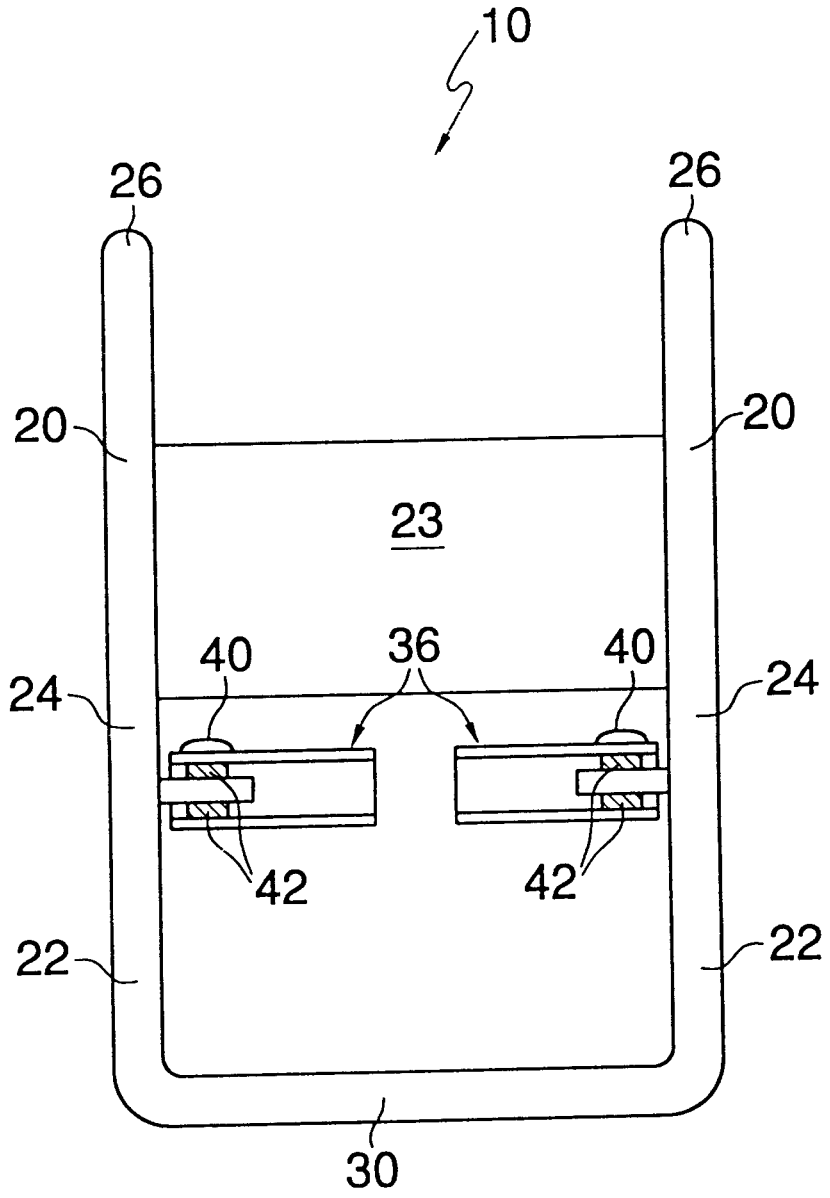
FIG. 1F is a rear view of the tool holder of FIG. 1A.

Referring to FIGS. 1A–1F, a first embodiment of a tool holder 10 has a support member 12 and bracket member 14. The support member 12 attaches to a belt, while the tool holding portion 14 supports a tool. The support member 12 has two front supports 16 and two rear supports 18. Each rear support 183 has a rear top portion 20, a rear bottom portion 22, and a rear transition portion 24 connected therebetween. The rear top portions 20 are connected to corresponding front supports 16 with a bend 26. In this embodiment, the bend 26 is arcuate in shape and approximately semicircular. It will be understood, however, that shapes other than the preferred shape shown are employable, such as a bend in the shape of a rectangular notch, a V-shape, or a crimp. The bend 26 is preferably rounded so that it is free of sharp points.

The front supports 16 and rear supports 18 are formed from a single length of wire. The wire is preferably a light weight metal such as aluminum, although other suitable materials include but are not limited to other metals, polymers, rubbers, composites, fiberglass, epoxy, and carbon-graphite. In some embodiments, the supports may be coated with a polymer layer which additionally improves the appearance of the product, allows the metal surface to have a lower tolerance finish, and provides some resilient cushioning between the supports and a belt.

The front supports 16 and rear top portions 20 are spaced from each other to provide adequate clearance for a belt. The front supports 16 and corresponding rear top portions 20 are biased substantially parallel to each other. Bends 26 provide a limited spring-like reaction to allow the supports to resiliently bend in response to applied forces and return to the initial spacing when the force ceases.

The front supports 16 are also spaced from and biased substantially nonparallel to the rear bottom portions 22. The rear bottom portions 22 are preferably disposed at an angle of about seven degrees behind the rear top portions 20, however other angles may be employed. Front supports 16 are connected by a bracket cross member 23.

Each rear transition portion 24 extends toward its corresponding front support to provide a narrow gap 28 which is smaller than the spacing between the front support 16 and the rear top portion 20. The gap 28 provides resistance to removal of the support member 12 from a belt.

The rear supports 18 are connected by a support cross member 30. Preferably, the support cross member 30 is disposed perpendicular to the rear bottom portions 22 and connected thereto, however in other embodiments the support cross member has an arcuate or other shape such that support cross member 30 is disposed at an angle other than ninety degrees with respect to the rear bottom portions 22. Transitions 32 between the support cross member 30 and the rear bottom portions 22 are preferably rounded. The support cross member 30 provides additional resistance to removal of the support member 12 from a belt.

Preferably, the rear bottom portions 22 of the support member 12 extend away from the front supports 16. Also, the rear bottom portions 22 of the support member 12 are preferably of substantially the same length as the rear top portions 20 of the support member 12.

The tool holding portion 14 is operatively associated with front supports 16, and has two forward portions 34 each connected at one end to a corresponding front support 16, and each connected at the other end to a forward extension 38. Two opposing gate members 36 form lower ends of tool holding portion 14, the gate members 36 being pivotally mounted to the forward extensions 38. The forward extensions 38 are preferably flat, with bores therethrough for receiving pivot: pins 40. The gate members 36 are preferably U-shaped, although other shapes such as L-shaped or C-shaped may be employed. A spring 42 is mounted around each pivot pin 40, and biases gate members 36 such that their front sides 44 face each other.

The gate members 36 allow a tool to be easily placed between forward portions 34 by engaging the gate members along sides 46 and causing them to pivot toward the front supports 16. Preferably, when the tool is in place, gate members 36 pivot back to their initial position, being disposed perpendicular to forward portions 34. Alternatively, only one gate member 36 needs to be pivotally mounted to a forward extension 38 to achieve this result, although two are preferred. These gate members simplify placement of the tool in the tool holding portion and is advantageous when the user is a precarious situation, such as on a ladder or scaffold.

Figure 2A:
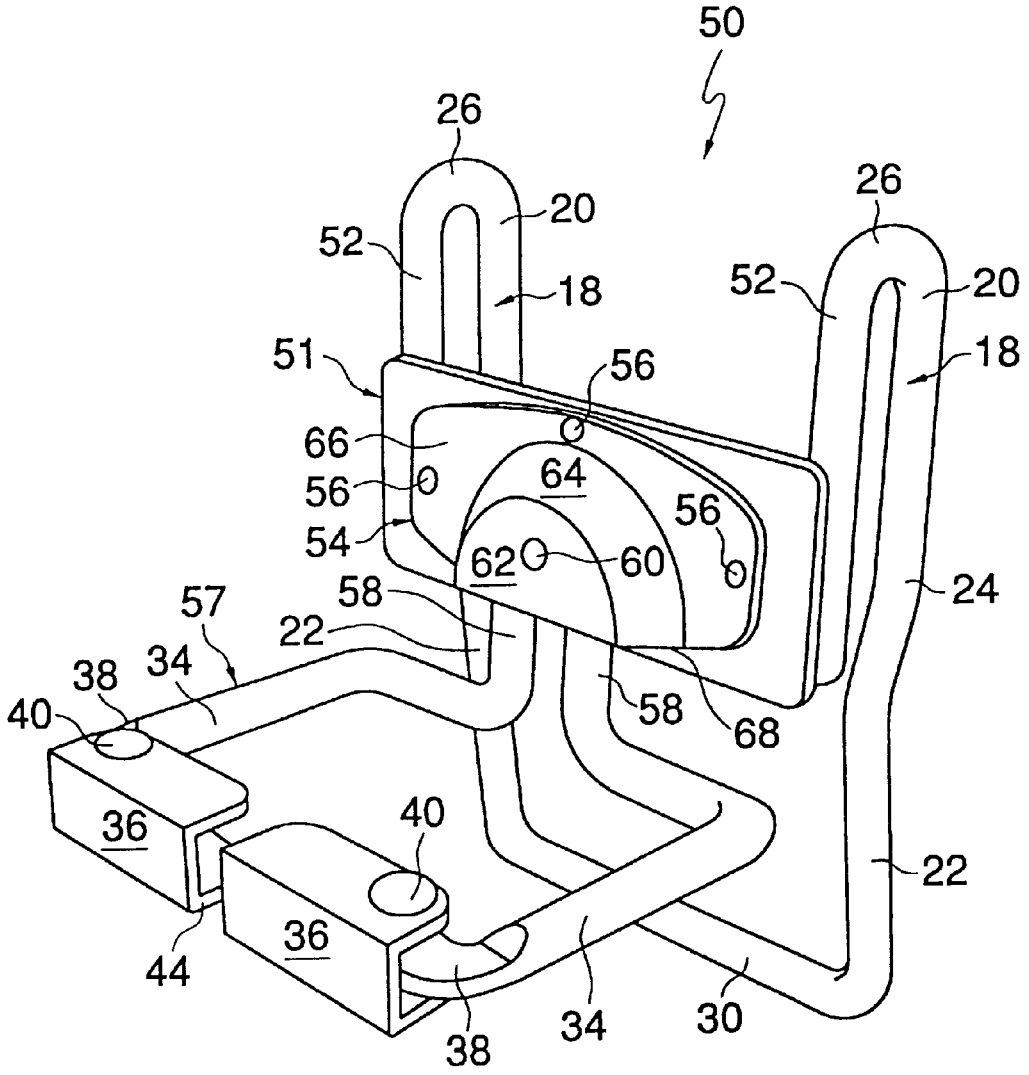
FIG. 2A is a perspective view of a second embodiment of a tool holder according to the present invention.
Figure 2B:
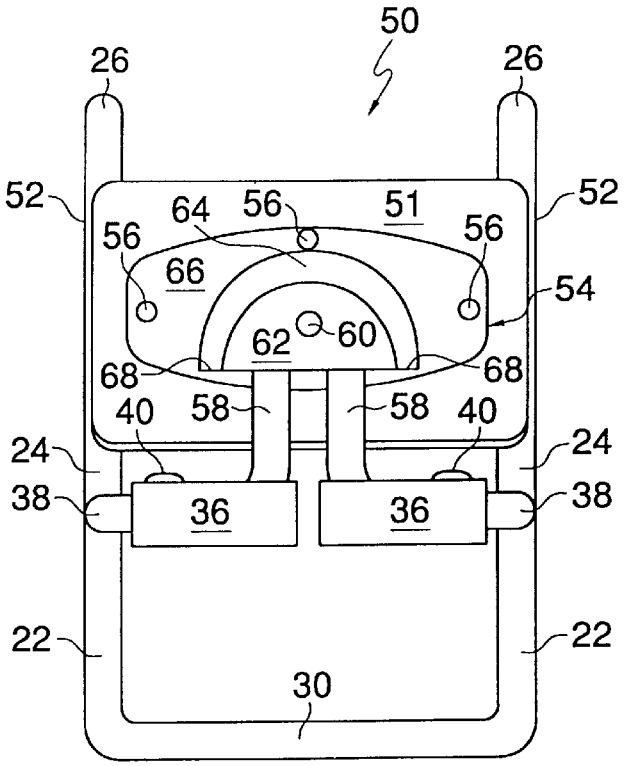
FIG. 2B is a front view of the tool holder of FIG. 2A.
Figure 2C:
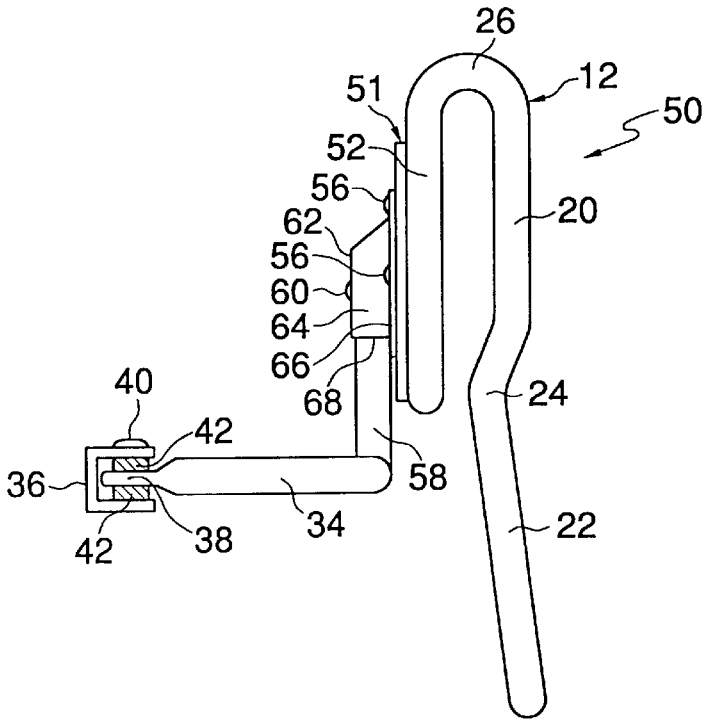
FIG. 2C is a side view of the tool holder of FIG. 2A.

FIGS. 2A–2F show another embodiment of tool holder in which the bracket member is pivotably connected to the bracket cross member. In the embodiment of FIG. 2A, front supports 52 are connected to bracket cross member 51. Front plate 54 is fixed to bracket cross member 51 by fastening means 56. Tool holding portion 57 includes rear extensions 58 mounted to front plate 54 rotatably about pin 60.

Figure 2D:
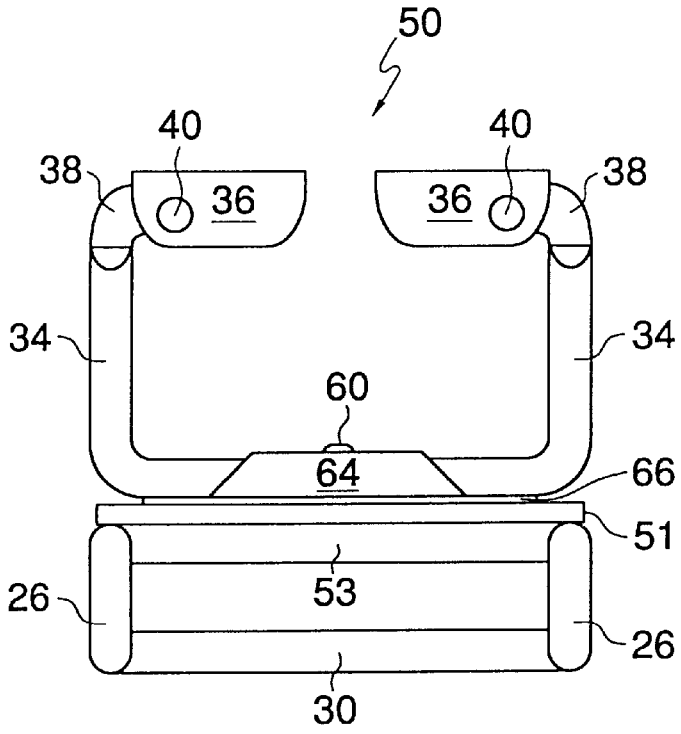
FIG. 2D is a top view of the tool holder of FIG. 2A.
Figure 2E:
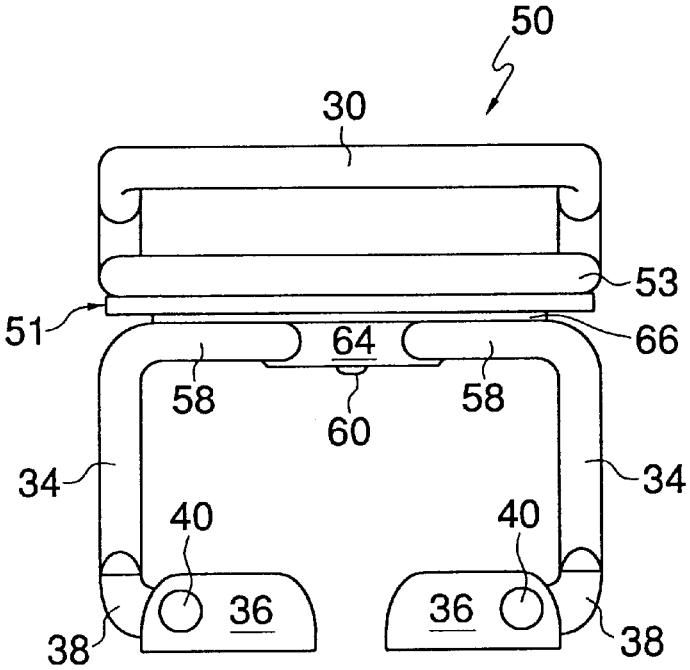
FIG. 2E is a bottom view of the tool holder of FIG. 2A.
Figure 2F:
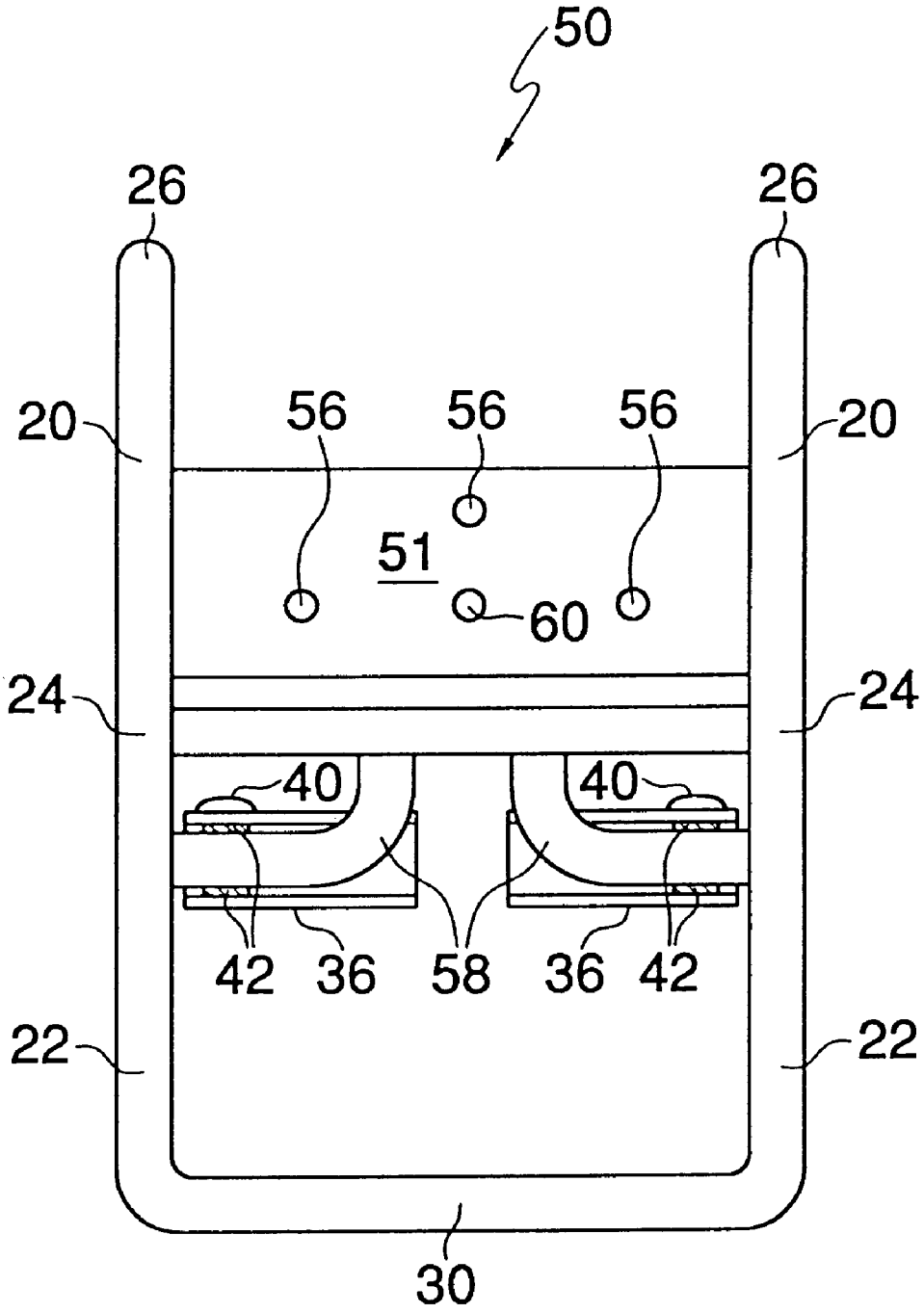
FIG. 2F is a rear view of the tool holder of FIG. 2A.

The embodiment of FIG. 2A defines a front plate with a raised portion 62, an intermediate portion 64, and a back portion 66. The intermediate portion 64 is dimensioned to receive rear extensions 58. Intermediate sides 68 limit the travel of the rear extensions 58, thereby preventing the tool holding portion 57 from pivoting a full turn clockwise or counterclockwise about pin 60. In an alternate embodiment, front supports 52 are connected by front member 53, as shown in FIG. 2D.

Figure 3A:
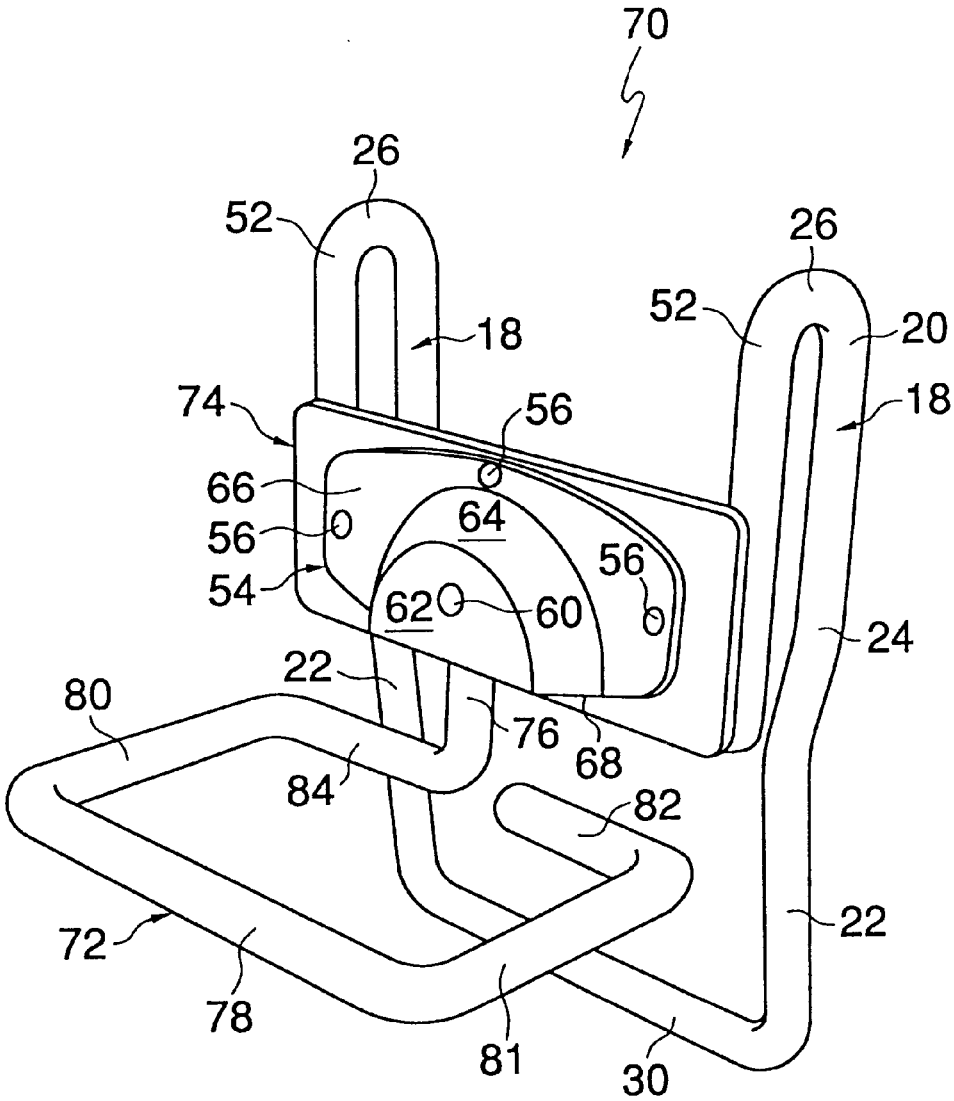
FIG. 3A is a perspective view of a third embodiment of a tool holder according to the present invention.
Figure 3B:
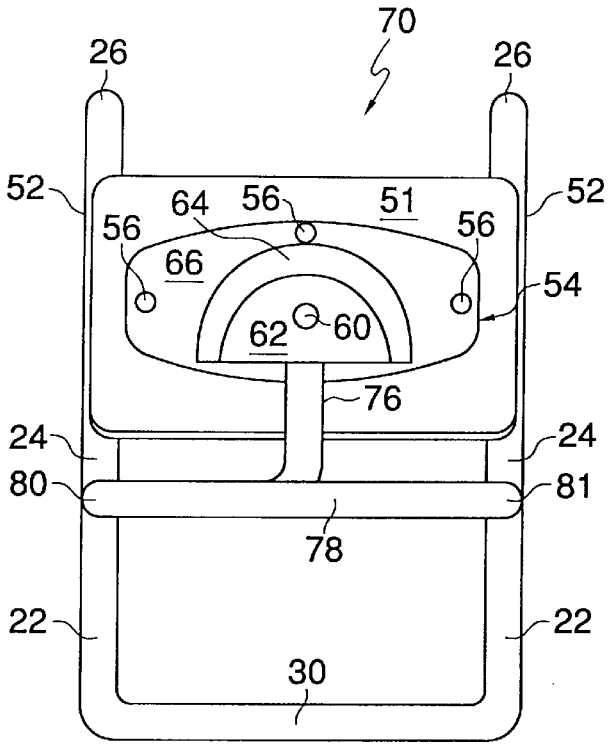
FIG. 3B is a front view of the tool holder of FIG. 3A.
Figure 3C:
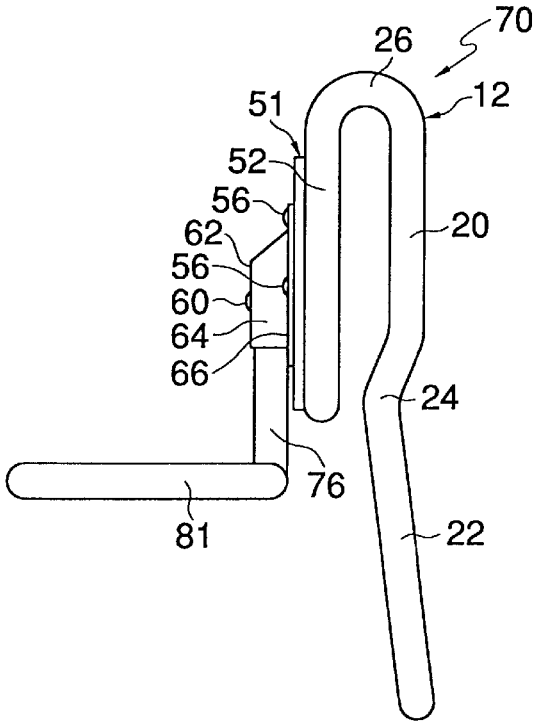
FIG. 3C is a side view of the tool holder of FIG. 3A.
Figure 3D:
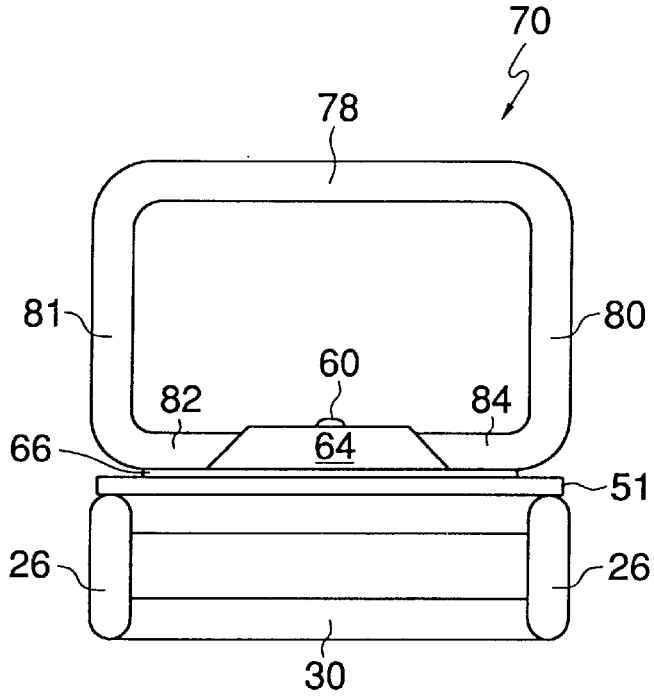
FIG. 3D is a top view of the tool holder of FIG. 3A.
Figure 3E:
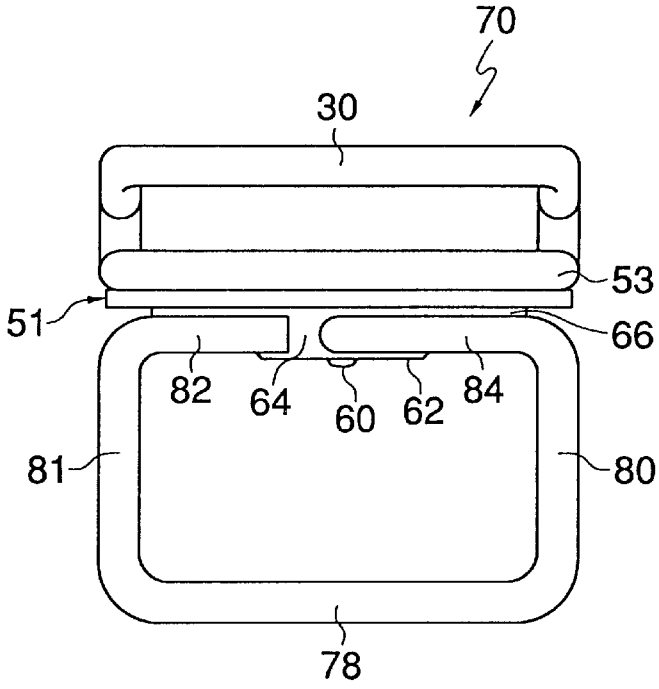
FIG. 3E is a bottom view of the tool holder of FIG. 3A.
Figure 3F:
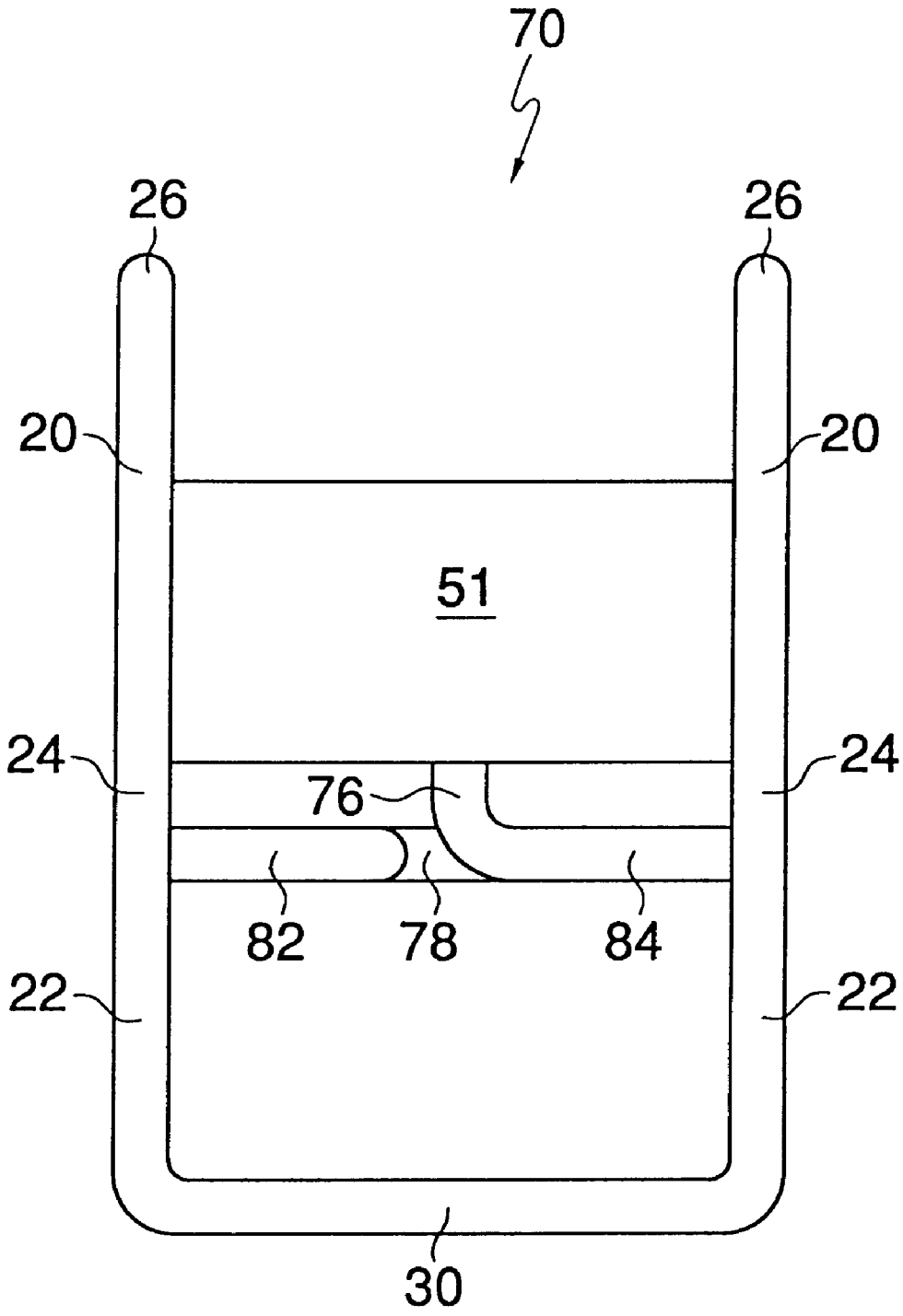
FIG. 3F is a rear view of the tool holder of FIG. 3A.

Referring to FIGS. 3A–3E, tool holder 70 includes a substantially rectangular bracket member 72 pivotably connected to the bracket cross member 74. In the embodiment of FIG. 3A, bracket member 72 includes rear extension 76 mounted to front plate 54 rotatably about pin 60. Intermediate sides 68 limit the travel of the rear extension 76, which preferably is greater than the possible pivot angle shown in the embodiment of FIG. 2A.

Bracket member 72 has a front portion 78 and side portions 80 and 81. An extension 82 is connected to side portion 81, and an extension 84 is connected between side portion 80 and rear extension 76. The front portion 78, side portions 80 and 81, and extensions 82 and 84 preferably lie in the same plane, and are preferably perpendicular to rear extension 76.

In the embodiments of FIGS. 2 and 3, the pivotable feature of the tool holding portion enables the tool to move, rotate and shift with the movement of the user to retain the tool in the most stable position. This helps retain the tool in the holder as the user is moving on equipment such as ladders, scaffolding, roofs, and the like.

The present invention is not to be limited to the specific designs shown herein as one of ordinary skill in the art can envision numerous variations and modifications. For example, the bracket member may be mounted directly to the bracket cross member rotatably about a pin. All of these modifications are contemplated by the true spirit and scope of the invention as defined by the following claims.

What is claimed is:

1. A tool holder for mounting on a user's belt comprising:

a support member having two front supports and two rear supports, each rear support having a rear to-p portion, a rear bottom portion, and a rear transition portion positioned therebetween, with each front support being spaced from and biased substantially parallel to the rear top portion and being nonparallel to the rear bottom portion, each rear transition portion extending toward the front support to provide a narrow gap which is smaller than the spacing between the front support and rear top portion, with the rear supports being connected by a support cross member, and the rear bottom portions extending away from the front supports;

a bracket cross member extending between and connecting the front supports; and a tool holding portion for holding a tool;

wherein, when the tool holder is mounted on a user's belt, the belt is received between the front supports and the top portions of the rear supports, while a lower portion of the front supports and the rear transition portions provide resistance to removal of the support member from the belt, aid the rear bottom portions are of substantially the same length as the rear top portions.

2. The tool holder of claim 1, wherein the tool holding portion is pivotably associated with the bracket cross member to permit movement of the tool holding portion with respect the bracket cross member.

3. The tool holder of claim 1, wherein the bracket cross member is a plate.

4. The tool holder of claim 1, wherein the tool holding portion includes a plurality of opposing gate members operatively associated therewith.

5. The tool holder of claim 4, wherein each gate member is mounted substantially perpendicularly to the rear supports of the support member.

6. The tool holder of claim 4, wherein each gate member is pivotably mounted about a pivot pin and biased in opposing position by a spring.

7. The tool holder of claim 4, wherein each gate member is mounted on a side member which forms a lower end of a front support.

8. The tool holder of claim 7, wherein each side member is joined to form a C-shaped portion that is pivotably connected to the bracket cross member.

9. The tool holder of claim 8, wherein the pivotable connection comprises a cover plate connected to the bracket cross member and a pivot pin extending therebetween.

10. The tool holder of claim 1, wherein the tool holding portion comprises a wire bent to form a substantially rectangular shape.

11. The tool holder of claim 10, wherein the substantially rectangular shape and the rear supports of the support member are disposed in substantially perpendicular planes.

12. The tool holder of claim 10, wherein a central region of the wire is pivotably connected to the bracket cross member.

13. The tool holder of claim 12, wherein the pivotable connection comprises a cover plate connected to the bracket cross member and a pivot pin extending therebetween.

* * * * *

UNITED STATES PATENT AND TRADEMARK OFFICE

CERTIFICATE OF CORRECTION

PATENT NO. : 6,199,736 B1
DATED : March 31, 2001
INVENTOR(S) : Musarella et al.

It is certified that error appears in the above-identified patent and that said Letters Patent is hereby corrected as shown below:

Column 6, claim 1,
Line 1, change "aid" to -- and --.

Column 6, claim 4,
Amend claim 4 as follows:
-- The tool holder of claim 1, wherein two tool holding portions are provided, each including an opposing gate member. --

Signed and Sealed this

First Day of January, 2002

*Attest:*

*Attesting Officer*

JAMES E. ROGAN
*Director of the United States Patent and Trademark Office*